US008024838B2

(12) United States Patent
Yip

(10) Patent No.: US 8,024,838 B2
(45) **Date of Patent: *Sep. 27, 2011**

(54) FRONT DOOR HINGE

(76) Inventor: Johnnie Yip, Rosemead, CA (US)

( * ) Notice: Subject to any disclaimer, the term of this patent is extended or adjusted under 35 U.S.C. 154(b) by 198 days.

This patent is subject to a terminal disclaimer.

(21) Appl. No.: 12/455,931

(22) Filed: Jun. 9, 2009

(65) Prior Publication Data

US 2010/0269299 A1 Oct. 28, 2010

Related U.S. Application Data

(63) Continuation-in-part of application No. 12/386,862, filed on Apr. 24, 2009, now Pat. No. 7,963,001.

(51) Int. Cl.
*E05D 7/06* (2006.01)

(52) U.S. Cl. ..... 16/241; 16/367; 16/239; 16/246; 16/366; 16/374; 296/146.11

(58) Field of Classification Search ..... 16/374, 16/367, 242, 235–239, 241, 246, 248, 105, 16/54, 50, 286, DIG. 23, 287; 296/146.11, 296/146.12, 76, 96, 146.8; 49/420, 425
See application file for complete search history.

(56) References Cited

U.S. PATENT DOCUMENTS 6,382,327 B1 * 5/2002 Mosdal ..... 172/311
6,676,193 B1 * 1/2004 Hanagan ..... 296/146.11
6,808,223 B1 * 10/2004 Baum et al. ..... 296/146.12
6,820,918 B1 * 11/2004 DeBono ..... 296/146.11
7,669,288 B2 * 3/2010 Zeilbeck et al. ..... 16/354
2003/0213102 A1 * 11/2003 Ham ..... 16/374
2004/0244144 A1 * 12/2004 Ham ..... 16/221
2005/0204511 A1 * 9/2005 Wohlfarth ..... 16/367
2005/0283948 A1 * 12/2005 Hyde ..... 16/361
2006/0096062 A1 * 5/2006 Woolcock ..... 16/238
2006/0123592 A1 * 6/2006 Yip ..... 16/241
2007/0228763 A1 * 10/2007 Duffy ..... 296/76
2008/0083089 A1 * 4/2008 Hoffman ..... 16/367
2008/0083090 A1 * 4/2008 Hoffman ..... 16/367
2009/0056074 A1 * 3/2009 Chase ..... 16/321

* cited by examiner

*Primary Examiner* — Chuck Y. Mah

(74) *Attorney, Agent, or Firm* — Clement Cheng

(57) ABSTRACT

A vertically opening vehicle door hinge has a base member secured to a chassis at bolt slots disposed as elongated openings on the base member. A primary swivel member is swivel mounted to the base member so that the primary swivel member swivels on the plane defined by the base member. The primary swivel member has a primary swivel axis normal to the point defined by the base member. The arm is swivel mounted to the primary swivel member at a secondary swivel. The secondary swivel has an secondary swivel axis of rotation normal to the primary swivel axis. The arm is mounted to a door of the vehicle. The arm has an extended position corresponding to an open vehicle door and a retracted position corresponding to a closed vehicle door.

19 Claims, 6 Drawing Sheets

FRONT DOOR HINGE

This application is a continuation in part of application Ser. No. 12/386,862 for Door Hinge filed Apr. 24, 2009 now U.S. Pat. No. 7,963,001 by same inventor Yip.

FIELD OF THE INVENTION

The invention relates to door hinge for vehicles.

DISCUSSION OF RELATED ART

A variety of vertically opening car door hinges have been made in the prior art. Unfortunately, the vertically opening car door hinge has a more complicated opening structure, and therefore it has been difficult in the past to provide a commercially responsive and lightweight structure for retrofitting with existing car doors of standard factory model vehicles. Vertically opening car door hinges have the advantage of less space used.

Previous attempts at car door hinges have been overly bulky, and accordingly weight requirements have limited the installation of the hinges. For example, Front Door Car Hinge by Yip, filed as U.S. patent application Ser. No. 11/014,022 filed Dec. 15, 2004 provides for a large base bracket connected to a second large door bracket, the disclosure of which is incorporated herein by reference. Other mechanisms, such as described by Baum in United States patent entitled Two Way Hinge For Motor Vehicle Doors U.S. Pat. No. 6,808,223 issued Oct. 26, 2004, the disclosure of which is incorporated herein by reference, suggests a similarly large and bulky construct. Both Yip Ser. No. 11/014,022 and Baum U.S. Pat. No. 6,808,223 require a large amount of space and have awkward joint construction.

Typically, automobile enthusiasts who enjoy customizing vehicles, also optimize vehicles for lower weight. Thus, it is an object of the invention to provide a space and weight optimized mechanical configuration to facilitate aftermarket retrofit door hinge automotive services.

SUMMARY OF THE INVENTION

The door hinge is comprised of a base member, upon which a primary swivel member is mounted. The primary swivel has a shock protrusion receiving a shock bracket which has a first face parallel to the shock protrusion and a second face facing the shock. The shock has an outer cylinder and a piston in telescopic connection to the outer cylinder. The outer cylinder is connected to a banjo receiver. The banjo receiver is in threaded connection and intimate connection with a base member bolt. The base member bolt has an external threading which preferably threads with an inside surface of the banjo receiver.

The door hinge base member has a pair of lower bolt slots and a middle bolt opening and a pair of upper bolt openings. The bolt openings and bolt slots are sized for standard automobile door hinge securing. The standard automobile door hinge can be replaced with the present embodiment door hinge.

A stopper bracket is formed on the base member and has a vertical face facing a stopper bolt. The stopper bracket is preferably formed as a U-shaped member with a flat face facing the stopper bolt.

The shock pushes the arm into an extended position corresponding to the opening of a car door. The arm is attached to the primary swivel member at a secondary swivel. The secondary swivel swivels outward to allow a car door mounted to the end of arm to open outwardly. The swivel axis is on the swivel axle passing through the swivel member and the base member. The secondary swivel passes first through the arm at a first connection finger, then the primary swivel member, before attaching began to the arm at a second connection finger.

The secondary swivel is limited in outward opening angle by a stopper finger which opposes a stopper on primary swivel. Preferably, the secondary swivel has an axle for rotation which passes through stopper finger as well as first connection finger and second connection finger.

A set screw may be threaded and secured into the stopper finger to provide an extension or retraction for adjustment of the maximum outward opening angle. Extension of set screw decreases the maximum outward opening angle and retraction of set screw increases the maximum outward opening angle. The maximum outward opening angle is sized according to a car door dimension. The set screw may have a means for adjusting, such as a Phillips or hexagonal drive surface.

The arm has a pair of branch members including a lower branch member and an upper branch member. The lower branch member is secured to a lower door plate and the upper branch member is secured to an upper door plate. The lower door plate and the upper door plate have bolt opening slots receiving bolts securing to a car door.

The upper branch member and the lower branch member are preferably made from a planar flat member which curves upward to meet a main portion of the arm which is connected to the primary swivel.

The stopper bolt has an adjusting nut for adjusting the length of the stopper bolt in protrusion from the arm. As an arm carries the car door upward after a user opens the car door, the stopper bolt has a ball point tip. The ball point tip is a rolling ball similar to a ballpoint pen construction where a steel ball is mounted on the tip of the stopper bolt. The steel ball ball point tip rolls on the flat surface of the stopper bracket. The shock both dampens and provides a spring bias for raising and lowering the car door.

The primary swivel member swivels in the same plane as the door hinge base member. The primary swivel member is made as a planar member and the door hinge base member is also made as a planar member. The door hinge base member can be secured to a vehicle on the pair of lower bolt slots and the pair of upper bolt openings into pre-existing bolt receiving openings on the vehicle. However, the middle bolt opening may have to be secured to the vehicle by a bolt after drilling a bolt opening on the vehicle.

The base member bolt can be received in a base member bolt opening. A plurality of base member bolt openings can be disposed on the base member by drilling multiple bolt openings.

Having multiple bolt openings allows adjustment for different types of vehicles so that the same door hinge can be used for multiple and varying types of vehicles.

A base stopper is formed as a bolt secured to the door hinge base member. The base stopper has a hexagonal securing means which also raises and lowers the base stopper. The base stopper is adjusted for limiting the angle of the arm relative to the base member after the arm has been raised over the base stopper.

Assembly of the device is slightly complicated by the force of the shock. One way of assembling the device is to first mount the base member to the vehicle chassis. After the base member is mounted to the vehicle chassis, the arm is mounted to the car door. The shock is kept disengaged. The shock can be in the first disengaged position or the second disengaged position. The shock can either be disengaged from base member bolt, or disengaged from shock bracket. The car door can be suspended by rope or a lift during the adjustment process. Once all of the parts are installed on the vehicle, the shock is installed. The door is then released and then the fit is tested. Most of the time, the fit will not be good, and adjustments will be made. The installer has a number of variables such as changing the mounting of the door hinge base member relative to the pair of lower bolt slots, or by fine-tuning an adjusting the stopper finger length via the set screw. The bolt opening slots on the arm can also be adjusted. Furthermore, the base member bolt can be inserted in a different base member bolt opening which is in a slightly different location, to allow for greater bearing on the shock, or less weight-bearing on the shock.

The geometry of the front door hinge provides that the shock remains pivoting in the same plane as the base member. The primary swivel member also pivots in the same plane as the base member and the shock protrusion and thus is on the same plane as the shock, the primary swivel member and the base member. The shock is mounted between the primary swivel member and the base member to allow simultaneous coplanar motion of the primary swivel member, the base member and the shock. The arm swivels outward away from the vehicle chassis and away from base member. The arm is also supported by the base stopper.

Figure 1:
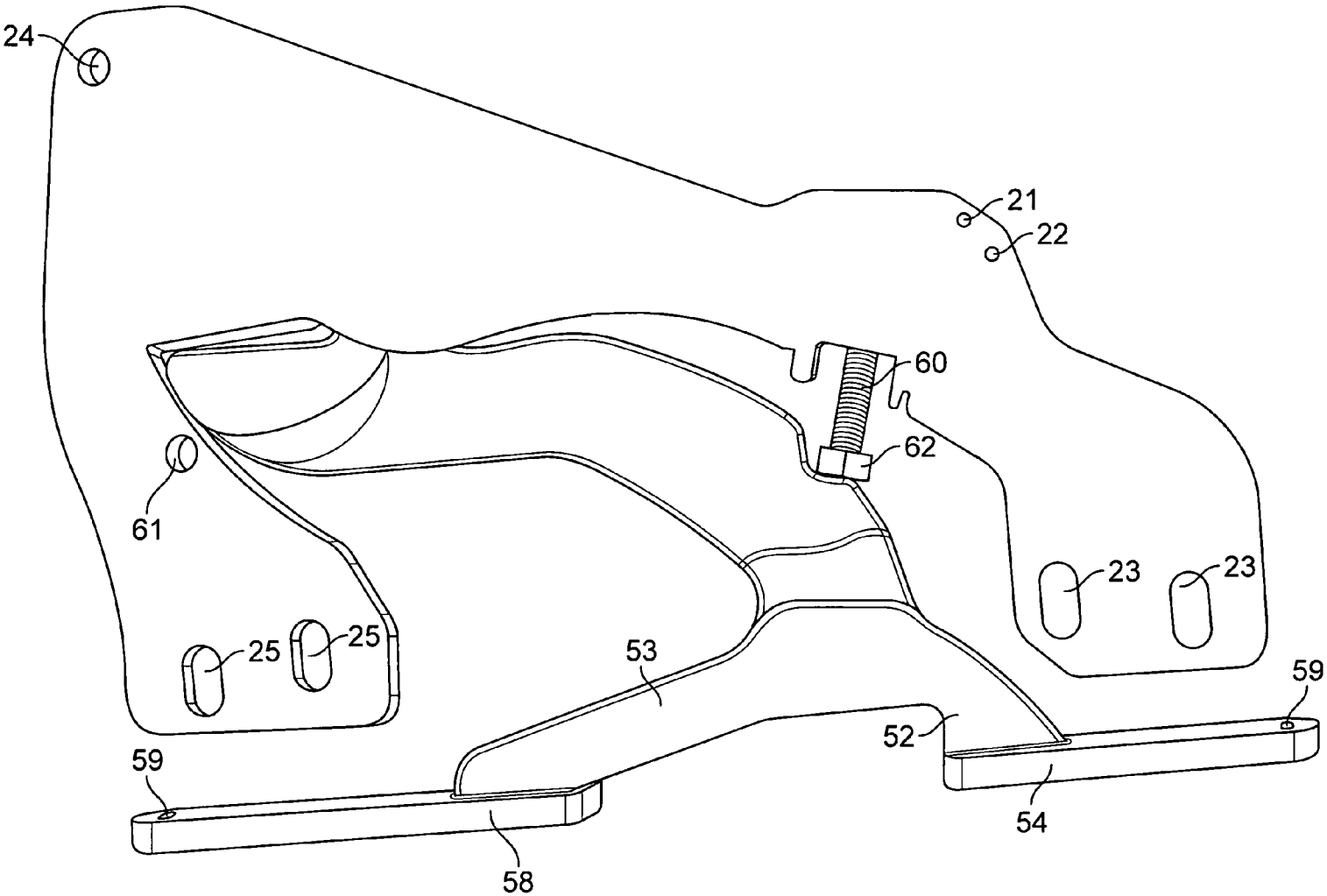
FIG. 1 is an inside view of the present invention from the perspective from the inside of an automobile.
Figure 2:
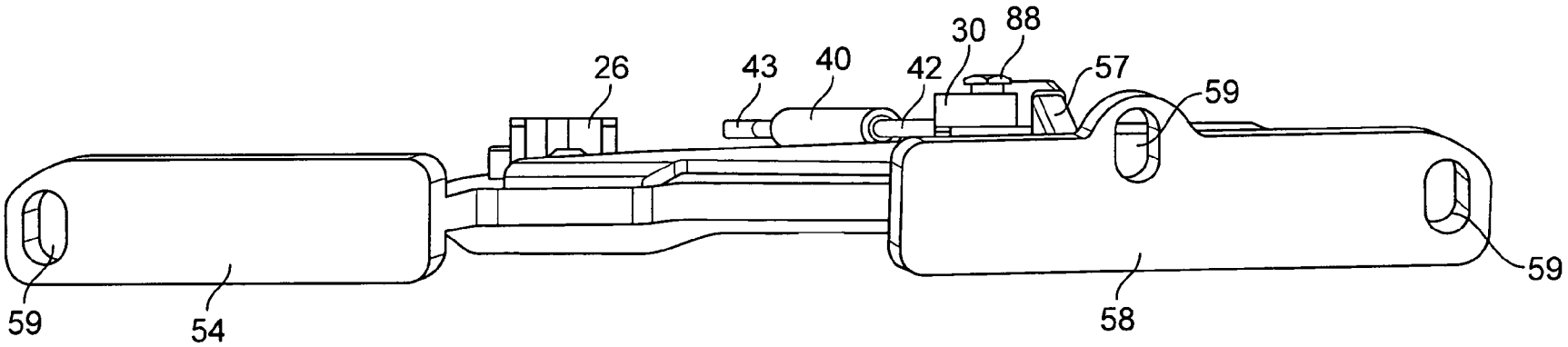
FIG. 2 is a rear view of the present invention.
Figure 3:
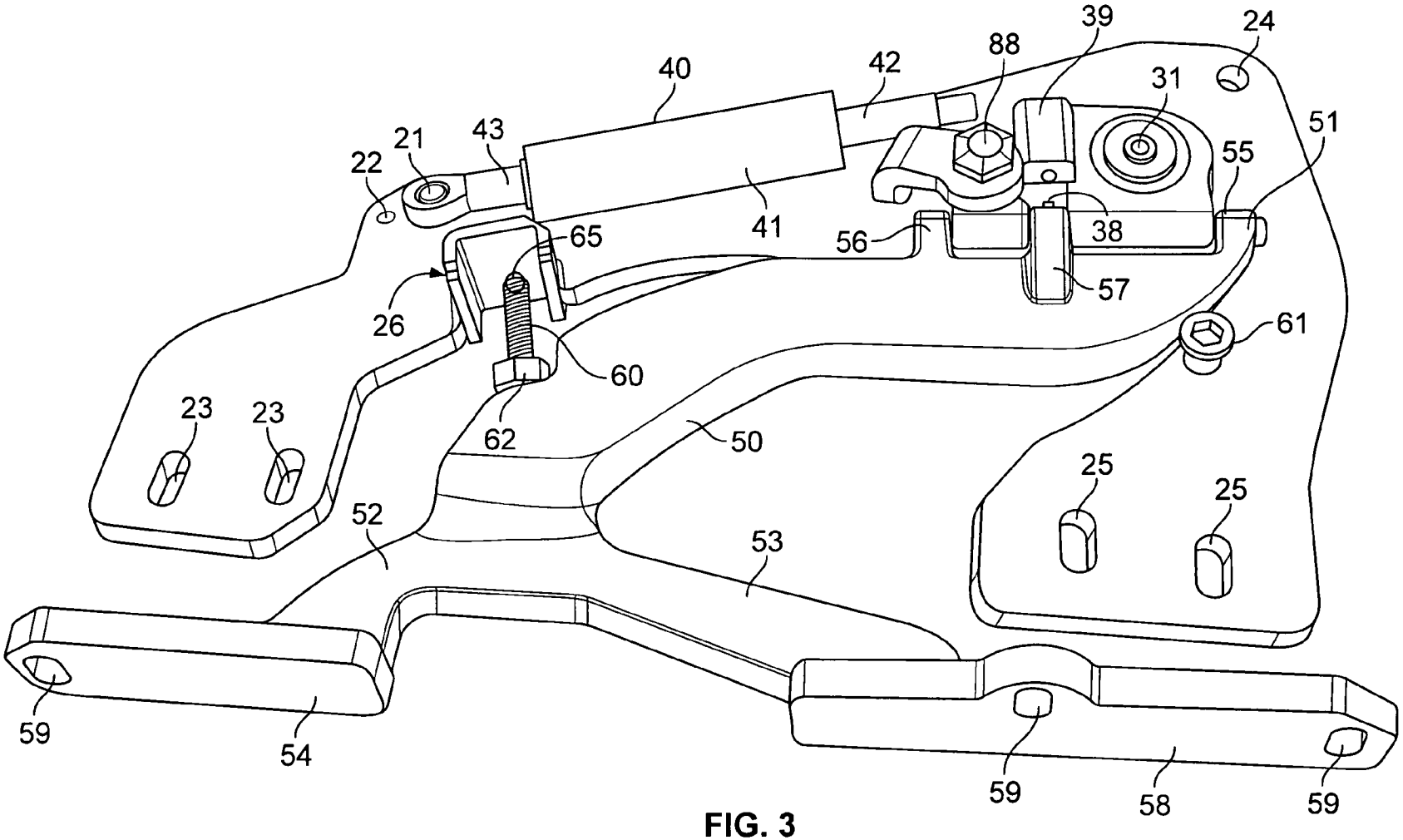
FIG. 3 is an outside view of the present invention in closed position, showing the shock in a first disengaged position.
Figure 4:
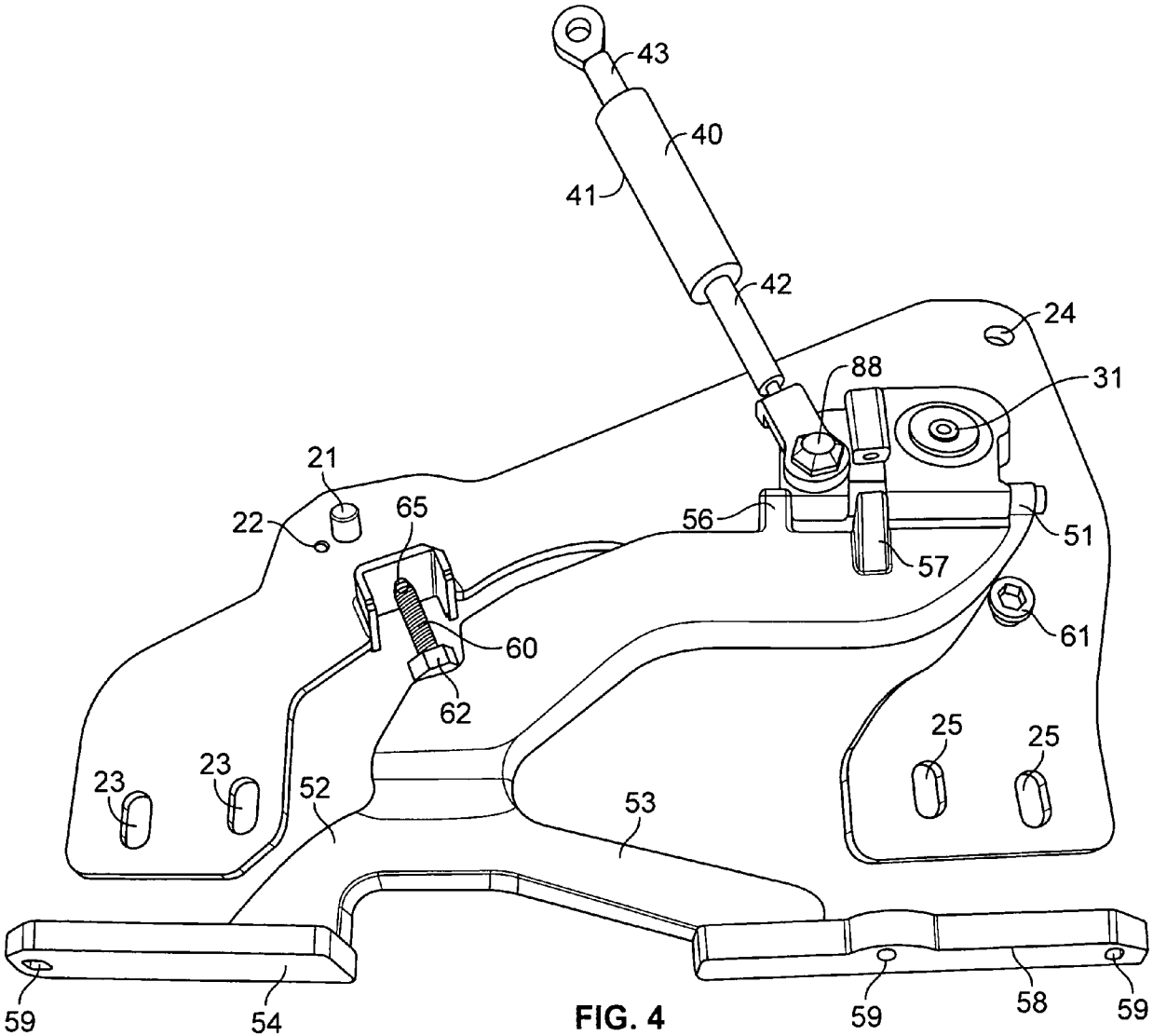
FIG. 4 is an outside view of the present invention in closed position, showing the shock in a second disengaged position.

The following call out list of elements is used consistently to refer to the elements of the drawings as follows:

20 Base Member
21 Bolt
23 Lower Bolt Slots
24 Middle Bolt Opening
25 Upper Bolt Openings
26 Stopper Bracket
30 Swivel Member
31 Swivel Axle
32 Shock Protrusion
33 Opening
34 Shock Bracket
38 Screw
39 Stopper
40 Shock
41 Outer Cylinder
42 Piston
43 Banjo Receiver
50 Arm
51 Secondary Swivel
52 Branch Member
53 Branch Member
54 Door Plate
55 Connection Finger
56 Connection Finger
57 Stopper Finger
58 Door Plate
59 Bolt Opening Slots
60 Stopper Bolt
61 Base Stopper
62 Adjusting Nut
65 Ball Tip
88 Shock Bracket Bolt

DETAILED DESCRIPTION OF THE PREFERRED EMBODIMENT

The door hinge is comprised of a base member 20, upon which a primary swivel member 30 is mounted. The primary swivel has a shock protrusion 32 receiving a shock bracket 34 which has a first face parallel to the shock protrusion and a second face facing the shock. The shock bracket 34 is in swivel connection to the primary swivel member 30 the shock bracket 34 has a shock bracket bolt 88 bolted through the primary swivel member 30 and the shock bracket 34 in a thickness direction. The shock bracket bolt 88 preferably has a lower portion that is threaded into an aperture of the primary swivel member 30. The shock bracket bolt 88 as a hexagonal head for allowing assembly and adjustment while the shock bracket bolt 88 is mounted under the fender of the vehicle. Thus, the shock bracket has a shock bracket axis of rotation parallel to the primary swivel axis.

The shock 40 has an outer cylinder 41 and a piston 42 in telescopic connection to the outer cylinder 41. The outer cylinder 41 is connected to a banjo receiver 43. The banjo receiver 43 is in threaded connection and intimate connection with a base member bolt 21. The base member bolt 21 has an external threading which preferably threads with an inside surface of the banjo receiver 43.

The door hinge base member 20 has a pair of lower bolt slots 23 and a middle bolt opening 24 and a pair of upper bolt openings 25. The bolt openings and bolt slots are sized for standard automobile door hinge securing. The standard automobile door hinge can be replaced with the present embodiment door hinge.

A stopper bracket 26 is formed on the base member 20 and has a vertical face facing a stopper bolt 60 disposed on the arm. The stopper bracket 26 is preferably formed as a U-shaped member with a flat face facing the stopper bolt 60 and providing a good rolling surface for a ball tip 65. The ball tip 65 is mounted to the tip of the stopper bolt and the ball tip can roll in any direction like a ballpoint pen relative to the stopper bolt 60. Preferably, the ball tip 65 is oiled for smooth rolling.

The shock 40 pushes the arm 50 into an extended position corresponding to the opening of a car door. The arm 50 is attached to the primary swivel member 30 at a secondary swivel 51. The secondary swivel swivels outward to allow a car door mounted to the end of arm 50 to open outwardly. The swivel axis is on the swivel axle 31 passing through the swivel member 30 and the base member 20. The secondary swivel 51 passes first through the arm 50 at a first connection finger 55, then the primary swivel member 30, before attaching began to the arm 50 at a second connection finger 56. The secondary swivel axis is normal to the primary swivel axis.

The secondary swivel 51 is limited in outward opening angle by a stopper finger 57 which opposes a stopper 39 on primary swivel 30. The stopper finger is formed as a protrusion on the arm 50. The stopper 39 may have an opening 33 on a side opposite to the stopper finger 57. The opening optionally allows access to an adjusting member such as a screw.

The adjusting member may have an engagement face such as a hexagonal drive for adjusting. The opening on a side opposite to the stopper finger 57 may provide access to the hexagonal drive. Preferably, the secondary swivel 51 has an axle for rotation which passes through stopper finger 57 as well as first connection finger 55 and second connection finger 56.

A set screw 38 may be threaded and secured into the stopper finger 57 to provide an extension or retraction for adjustment of the maximum outward opening angle. Extension of set screw 38 decreases the maximum outward opening angle and retraction of set screw 38 increases the maximum outward opening angle. The maximum outward opening angle is sized according to a car door dimension. The set screw may have a means for adjusting, such as a Phillips or hexagonal drive surface.

The arm 50 has a pair of branch members including a lower branch member 52 and an upper branch member 53. The lower branch member is secured to a lower door plate 54 and the upper branch member is secured to an upper door plate 58. The lower door plate 54 and the upper door plate 58 have bolt opening slots 59 receiving bolts securing to a car door. The upper branch member and the lower branch member are preferably made from a planar flat member which curves upward to meet a main portion of the arm 50 which is connected to the primary swivel 30.

The stopper bolt 60 has an adjusting nut 62 for adjusting the length of the stopper bolt 60 in protrusion from the arm 50. As an arm 50 carries the car door upward after a user opens the car door, the stopper bolt 60 has a ball point tip 65. The ball point tip is a rolling ball similar to a ballpoint pen construction where a steel ball is mounted on the tip of the stopper bolt 60. The steel ball point tip 65 rolls on the flat surface of the stopper bracket 26. The shock both dampens and provides a spring bias for raising and lowering the car door.

The primary swivel member swivels in the same plane as the door hinge base member 20. The primary swivel member is made as a planar member and the door hinge base member 20 is also made as a planar member. The door hinge base member 20 can be secured to a vehicle on the pair of lower bolt slots 23 and the pair of upper bolt openings 25 into pre-existing bolt receiving openings on the vehicle. However, the middle bolt opening 24 may have to be secured to the vehicle by a bolt after drilling a bolt opening on the vehicle.

The base member bolt 21 can be received in a base member bolt opening. A plurality of base member bolt openings can be disposed on the base member 20 by drilling multiple bolt openings 21, 22. Having multiple bolt openings allows adjustment for different types of vehicles so that the same door hinge can be used for multiple and varying types of vehicles. The multiple bolt openings can optionally be plugged when not in use.

A base stopper 61 is formed as a bolt secured to the door hinge base member 20. The base stopper 61 has a hexagonal securing means which also raises and lowers the base stopper 61. The base stopper 61 is adjusted for limiting the angle of the arm 50 relative to the base member 20 after the arm 50 has been raised over the base stopper 61. The base stopper biases the arm away from the base position when the arm is an extended position.

Figure 5:
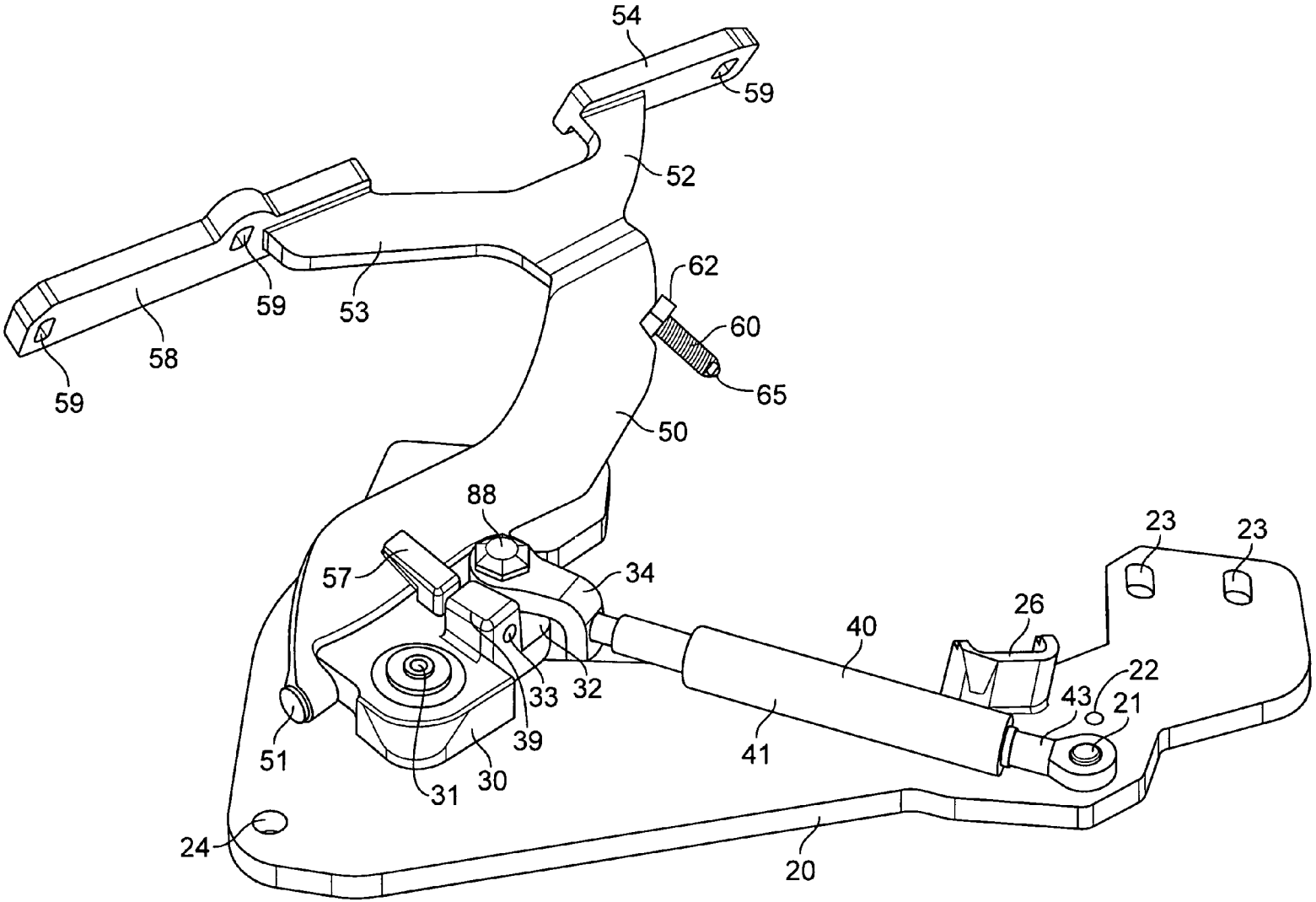
FIG. 5 is an outside view of the present invention in open and extended position, showing the shock in an engaged position.
Figure 6:
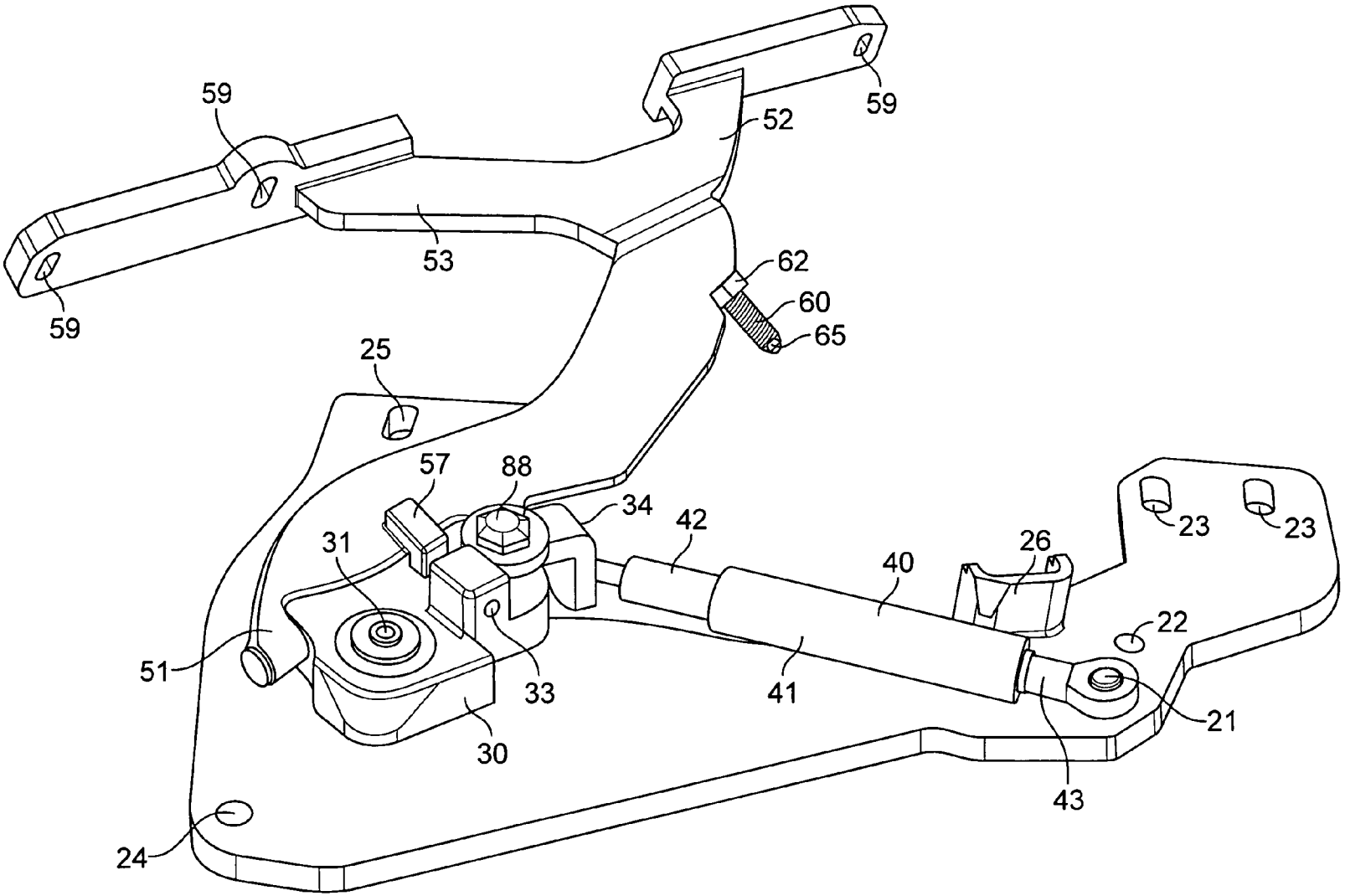
FIG. 6 is an outside view of the present invention in open and slightly retracted position, showing the shock in an almost engaged position right before final installation as shown in FIG. 5.

Assembly of the device is slightly complicated by the force of the shock 40. One way of assembling the device is to first mount the base member 20 to the vehicle chassis. After the base member 20 is mounted to the vehicle chassis, the arm 50 is mounted to the car door. The shock is kept disengaged as seen in FIGS. 2, 3, 4 or 6. The shock can be in the first disengaged position or the second disengaged position. The shock can either be disengaged from base member bolt 21, or disengaged from shock bracket 34. The car door can be suspended by rope or a lift during the adjustment process. Once all of the parts are installed on the vehicle, the shock is installed as seen in FIG. 5. The door is then released and then the fit is tested. Most of the time, the fit will not be good, and adjustments will be made. The installer has a number of variables such as changing the mounting of the door hinge base member relative to the pair of lower bolt slots 23, or by fine-tuning an adjusting the stopper finger length via the set screw. The bolt opening slots 59 on the arm 50 can also be adjusted. Furthermore, the base member bolt 21 can be inserted in a different base member bolt opening which is in a slightly different location, to allow for greater bearing on the shock, or less weight-bearing on the shock. The different base member bolt opening is called the secondary base member bolt opening 22. The secondary base member bolt opening is preferably adjacent to the primary base member bolt opening.

The air shock is preferably loaded up to about 50% of its travel distance capacity, and no more than 75% of the travel distance capacity. The half loading of the shock is accomplished by sizing the shock so that it is 50% loaded when the door is closed. A shock is loaded half way when the piston travels half of its distance in telescopic contraction into the shock body. When the vehicle door is closed, the apparatus arm is in retracted position as opposed to an extended position when the door is open. The air shock pushes outwardly in telescopic orientation. The shock has an area of trapped air and a base for storing the trapped air. The air shock can be selected from a variety of commonly available shocks. By opening the door, and holding it open with a lifting device, the shock can be replaced if necessary, such as if it fails. Typically, the shock will be loaded between 40% and 75% depending on the door structure and the motion desired by the user.

The geometry of the front door hinge provides that the shock remains pivoting in the same plane as the base member 20. The primary swivel member also pivots in the same plane as the base member 20 and the shock protrusion 32 and thus is on the same plane as the shock, the primary swivel member and the base member 20. The shock is mounted between the primary swivel member and the base member to allow simultaneous coplanar motion of the primary swivel member, the base member and the shock. The arm 50 swivels outward away from the vehicle chassis and away from base member 20. The arm 50 is also supported by the base stopper 61.

Fabrication of the parts is preferably from steel plate of sufficient thickness to support the car door. Preferably, ⅜" plate is used. The parts can be welded together, such as the stopper bracket 26 which is preferably welded to the base member 20.

The swivel joints can be substituted with a joint having the same or greater degree of freedom. Thus, although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. A front door hinge comprising:

a. a base member, made of a flat piece of metal defining a plane, wherein the base member includes bolt slots disposed as elongated openings on the base member;

b. a primary swivel member which is swivelly mounted to the base member so that the primary swivel member swivels on the plane defined by the base member, and wherein the primary swivel member has a primary swivel axis normal to the plane defined by the base member, wherein the primary swivel member defines a plane of the primary swivel member;

c. an arm extended from the primary swivel member, wherein the arm is swivelly mounted to the primary swivel member at a secondary swivel, wherein the secondary swivel has an secondary swivel axis of rotation normal to the primary swivel axis, wherein the arm for the comprises bolt slots, wherein the arm is mounted to a door of the vehicle, wherein the arm has an extended position corresponding to an open vehicle door and a retracted position corresponding to a closed vehicle door;

d. a shock bracket mounted to the primary swivel member by a shock bracket bolt, wherein the shock bracket has a shock bracket axis of rotation parallel to the primary swivel axis; and e. a shock mounted between the shock bracket and the base member, wherein simultaneous coplanar motion of the primary swivel member, the base member and the shock allow the shock to move on the plane of the primary swivel member and the base member, wherein the shock has a shock base end attaching to a base member bolt.

2. The front door hinge of claim 1, wherein the shock is loaded to about between 40% and 75% of the shock's travel distance.

3. The front door hinge of claim 1, wherein the primary swivel member further comprises a shock protrusion, wherein the shock bracket is mounted to the shock protrusion of the primary swivel member, wherein the shock bracket bolt is mounted to the shock protrusion of the primary swivel member, and wherein the shock bracket further comprises a first face parallel to a shock protrusion face, and wherein the shock bracket further comprises a second face which faces in a direction of the shock which is a direction that the shock moves, wherein the shock is secured to the second face.

4. The front door hinge of claim 1, further comprising: a banjo-shaped receiver disposed on the shock base end, wherein the banjo-shaped receiver receives the base member bolt securing the shock base end in pivotal connection to the base member.

5. The front door hinge of claim 1, further comprising: a primary base member bolt opening disposed on the base member, and a secondary base member bolt opening disposed on the base member adjacent to the primary base member bolt opening, wherein the primary base member bolt opening is shaped to receive a bolt.

6. The front door hinge of claim 1, further comprising: a stopper bracket formed on the base member and having a vertical face facing a stopper bolt disposed on the arm, and further comprising a ball tip mounted in the tip of the stopper bolt, wherein the ball tip rolls on the vertical face of the stopper bracket when the arm returns to the retracted position, wherein the stopper bolt is threadedly secured to the arm so as to be adjustable in length.

7. The front door hinge of claim 6, wherein the shock is loaded to about between 40% and 75% of a travel distance of the shock.

8. The front door hinge of claim 6, wherein the primary swivel member further comprises a shock protrusion, wherein the shock bracket is mounted to the shock protrusion of the primary swivel member, wherein the shock bracket bolt is mounted to the shock protrusion of the primary swivel member, and wherein the shock bracket further comprises a first face parallel to a shock protrusion face, and wherein the shock bracket further comprises a second face which faces in the direction of the shock which is a direction that the shock moves, wherein the shock is secured to the second face.

9. The front door hinge of claim 6, further comprising: a banjo-shaped receiver disposed on the shock base end, wherein the banjo-shaped receiver receives a base member bolt securing the shock base end in pivotal connection to the base member.

10. The front door hinge of claim 6, further comprising: a primary base member bolt opening disposed on the base member, and a secondary base member bolt opening disposed on the base member adjacent to the primary base member bolt opening.

11. A front door hinge for a vehicle comprising:

a. a base member, made of a flat piece of metal defining a plane, wherein the base member includes bolt slots disposed as elongated openings on the base member;

b. a primary swivel member which is swivelly mounted to the base member so that the primary swivel member swivels on the plane defined by the base member, and wherein the primary swivel member has a primary swivel axis normal to the plane defined by the base member, wherein the primary swivel member defines a plane of the primary swivel member;

c. an arm extended from the primary swivel member, wherein the arm is swivelly mounted to the primary swivel member at a secondary swivel, wherein the secondary swivel has an secondary swivel axis of rotation normal to the primary swivel axis, wherein the arm for the comprises bolt slots, wherein the arm is mounted to a door of the vehicle, wherein the arm has an extended position corresponding to an open vehicle door and a retracted position corresponding to a closed vehicle door;

d. a shock bracket mounted to the primary swivel member by a shock bracket bolt, wherein the shock bracket has a shock bracket axis of rotation parallel to the primary swivel axis;

e. a shock mounted between the shock bracket and the base member, wherein simultaneous coplanar motion of the primary swivel member, the base member and the shock allow the shock to move on the plane of the primary swivel member and the base member, wherein the shock has a shock base end attaching to a base member bolt;

f. a stopper bracket formed on the base member and having a vertical face facing a stopper bolt disposed on the arm, and further comprising a ball tip mounted in the tip of the stopper bolt, wherein the ball tip rolls on the vertical face of the stopper bracket when the arm returns to a retracted position, wherein the stopper bolt is threadedly secured to the arm so as to be adjustable in length; and g. a banjo-shaped receiver disposed on the shock base end, wherein the banjo-shaped receiver receives a base member bolt securing the shock base end in pivotal connection to the base member.

12. The front door hinge of claim 11, wherein the shock is loaded to about between 40% and 75% of the shock's travel distance.

13. The front door hinge of claim 11, wherein the primary swivel member further comprises a shock protrusion, wherein the shock bracket is mounted to the shock protrusion of the primary swivel member, wherein the shock bracket bolt is mounted to the shock protrusion of the primary swivel member, and wherein the shock bracket further comprises a first face parallel to a shock protrusion face, and wherein the shock bracket further comprises a second face which faces in a direction of the shock which is a direction that the shock moves, wherein the shock is secured to the second face.

14. The front door hinge of claim 11, further comprising: a primary base member bolt opening disposed on the base member, and a secondary base member bolt opening disposed on the base member adjacent to the primary base member bolt opening.

15. A front door hinge for a vehicle comprising:

a. a base member, made of a flat piece of metal defining a plane, wherein the base member includes bolt slots disposed as elongated openings on the base member;

b. a primary swivel member which is swivel mounted to the base member so that the primary swivel member swivels on the plane defined by the base member, and wherein the primary swivel member has a primary swivel axis normal to the plane defined by the base member, wherein the primary swivel member defines a plane of the primary swivel member;

c. an arm extended from the primary swivel member, wherein the arm is swivel mounted to the primary swivel member at a secondary swivel, wherein the secondary swivel has an secondary swivel axis of rotation normal to the primary swivel axis, wherein the arm for the comprises bolt slots, wherein the arm is mounted to a door of the vehicle, wherein the arm has an extended position corresponding to an open vehicle door and a retracted position corresponding to a closed vehicle door;

d. a shock bracket mounted to the primary swivel member by a shock bracket bolt, wherein the shock bracket has a shock bracket axis of rotation parallel to the primary swivel axis;

e. a shock mounted between the shock bracket and the base member, wherein simultaneous coplanar motion of the primary swivel member, the base member and the shock allow the shock to move on the plane of the primary swivel member and the base member, wherein the shock has a shock base end attaching to a base member bolt;

f. a stopper bracket formed on the base member and having a vertical face facing a stopper bolt disposed on the arm, and further comprising a ball tip mounted in the tip of the stopper bolt, wherein the ball tip rolls on the vertical face of the stopper bracket when the arm returns to a retracted position, wherein the stopper bolt is threadedly secured to the arm so as to be adjustable in length; and g. a base stopper disposed on the base member, wherein the base stopper biases the arm away from the base member when the arm is in extended position.

16. The front door hinge of claim 15, wherein the primary swivel member further comprises a shock protrusion, wherein the shock bracket is mounted to the shock protrusion of the primary swivel member, wherein the shock bracket bolt is mounted to the shock protrusion of the primary swivel member, and wherein the shock bracket further comprises a first face parallel to a shock protrusion face, and wherein the shock bracket further comprises a second face which faces in a direction of the shock which is a direction that the shock moves, wherein the shock is secured to the second face.

17. The front door hinge of claim 15, further comprising: a banjo-shaped receiver disposed on the shock base end, wherein the banjo-shaped receiver receives a base member bolt securing the shock base end in pivotal connection to the base member.

18. The front door hinge of claim 15, further comprising: a primary base member bolt opening disposed on the base member, and a secondary base member bolt opening disposed on the base member adjacent to the primary base member bolt opening, wherein the primary base member bolt opening is shaped to receive a bolt.

19. The front door hinge of claim 15, further comprising: a stopper bracket formed on the base member and having a vertical face facing a stopper bolt disposed on the arm, and further comprising a ball tip mounted in the tip of the stopper bolt, wherein the ball tip rolls on the vertical face of the stopper bracket when the arm returns to a retracted position, wherein the stopper bolt is threadedly secured to the arm so as to be adjustable in length.

* * * * *